US007286004B2

(12) United States Patent
Inoue

(10) Patent No.: US 7,286,004 B2
(45) Date of Patent: Oct. 23, 2007

(54) CURRENT SOURCE CIRCUIT

(75) Inventor: Atsuo Inoue, Otokuni-gun (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 19 days.

(21) Appl. No.: 11/253,613

(22) Filed: Oct. 20, 2005

(65) Prior Publication Data

US 2006/0087367 A1 Apr. 27, 2006

(30) Foreign Application Priority Data

Oct. 22, 2004 (JP) ..... 2004-307519

(51) Int. Cl.
*G05F 1/10* (2006.01)

(52) U.S. Cl. ..... 327/543; 327/143

(58) Field of Classification Search ..... 323/315, 323/316; 327/535, 538, 539, 543
See application file for complete search history.

(56) References Cited

U.S. PATENT DOCUMENTS 4,769,589 A * 9/1988 Rosenthal ..... 323/313
4,890,052 A * 12/1989 Hellums ..... 323/315
5,243,231 A * 9/1993 Baik ..... 327/544
5,528,182 A * 6/1996 Yokosawa ..... 327/143
5,619,160 A * 4/1997 Sirito-Olivier et al. ..... 327/530
5,825,237 A * 10/1998 Ogawa ..... 327/545
5,969,549 A * 10/1999 Kim et al. ..... 327/143
6,351,111 B1 * 2/2002 Laraia ..... 323/315
6,356,064 B1 * 3/2002 Tonda ..... 323/313
6,586,975 B2 * 7/2003 Nagaya et al. ..... 327/143
6,600,361 B2 * 7/2003 Nagaya et al. ..... 327/538
6,998,902 B2 * 2/2006 Sugimura ..... 327/539
7,057,448 B2 * 6/2006 Tanigawa et al. ..... 327/543

* cited by examiner

*Primary Examiner*—Jeffrey Zweizig
(74) *Attorney, Agent, or Firm*—Steptoe & Johnson LLP

(57) ABSTRACT

According to the present invention, after a bias circuit (20) starts, a startup circuit (10) is isolated from the bias circuit (20) according to a bias voltage generated on an isolating voltage node (V2) from the bias circuit (20) to the startup circuit (10), and steady current consumption can be prevented in the startup circuit (10).

2 Claims, 5 Drawing Sheets

CURRENT SOURCE CIRCUIT

FIELD OF THE INVENTION

The present invention relates to a current source circuit in which a startup circuit operates to start a bias circuit at power-on for starting a device.

BACKGROUND OF THE INVENTION

Conventionally, in a semiconductor integrated circuit device or the like including a plurality of digital circuits and analog circuits which form various functional blocks, a startup circuit operates at power-on for starting the device. To supply bias voltage to the various functional blocks after the operation, a current source circuit for starting a bias circuit for generating bias voltage is externally connected or included.

Such a conventional current source circuit will be discussed below in accordance with the accompanying drawings.

For example, FIG. 5 is a circuit diagram showing the configuration of a conventional current source circuit disclosed in "CMOS Circuit Design, Layout, and Simulation" by R. Jacob Baker, Harry W. Li, David E. Boyce, John Wiley & Sons Inc., 1997, pp. 470 to 471. As shown in FIG. 5, in the basic configuration of a conventional current source circuit 1, a startup circuit 60 and a bias circuit 20 are connected to each other. The startup circuit 60 operates between a power supply VDD and ground GND when the power supply VDD is turned on, and the bias circuit 20 starts to pass current when the startup circuit 60 operates.

The startup circuit 60 is comprised of a PMOS transistor 61 having a source connected to the power supply VDD and having a gate and a drain connected to a control voltage node V3, an NMOS transistor 62 having a drain and a gate connected to the control voltage node V3 and a source connected to the ground GND, and an NMOS transistor 63 having a drain connected to the power supply VDD, a gate connected to the control voltage node V3, and a source connected to a starting voltage node V1.

The bias circuit 20 is comprised of a PMOS transistor 21 having a source connected to the power supply VDD and a drain connected to the starting voltage node V1, a PMOS transistor 22 having a source connected to the power supply VDD and having a gate and a drain connected to the gate of the PMOS transistor 21, an NMOS transistor 23 having a drain and a gate connected to the starting voltage node V1 and a source connected to the ground GND, an NMOS transistor 24 having a drain connected to the gate and drain of the PMOS transistor 22 and a gate connected to the starting voltage node V1, and a resistor 25 connected between the source of the NMOS transistor 24 and the ground GND.

The following will summarize the operations of the current source circuit 1 configured thus.

Immediately after the power supply VDD is applied, the PMOS transistors 21 and 22 and the NMOS transistors 23 and 24 of the bias circuit 20 are shut off. That is, current does not pass through a current mirror circuit 20*a* of the bias circuit 20 and a bias voltage V2*b* is not outputted.

The NMOS transistor 63 is forced into conduction by increasing the voltage of the control voltage node V3 of the startup circuit 60, the gate voltage of the NMOS transistors 23 and 24 is increased, and current is passed through the NMOS transistors 23 and 24, so that current starts passing through the current mirror circuit 20*a*.

The following will discuss the operations of the current source circuit 1 in a step-by-step manner.

First, when the power supply VDD is applied, a control voltage divided by the PMOS transistor 61 and the NMOS transistor 62, which are connected in series, is generated on the control voltage node V3. The control voltage of the control voltage node V3 forces the NMOS transistor 63 into conduction, the gate voltage of the NMOS transistors 23 and 24 is increased, and the bias circuit 20 starts to pass current, so that current starts passing through the current mirror circuit 20*a*.

Once the bias circuit 20 starts, the voltage of the starting voltage node V1 also increases and brings the NMOS transistor 63 out of conduction, so that the startup circuit 60 is electrically isolated from the bias circuit 20.

In such a conventional current source circuit 1, after the bias circuit 20 starts, the startup circuit 60 is electrically isolated from the bias circuit 20. In the startup circuit 60, however, a steady current keeps passing through a series circuit starting from the power supply VDD to the ground GND through the PMOS transistor 61 and the NMOS transistor 62 even after the start of the bias circuit 20. Thus, unnecessary power consumption continues in the startup circuit 60, which is a problem in achieving low power consumption in the overall circuit.

DISCLOSURE OF THE INVENTION

The present invention is devised to solve the conventional problem. An object of the present invention is to provide a current source circuit which can eliminate unnecessary power consumption after the start of a bias circuit and reduce the power consumption of the overall circuit.

A current source circuit of the present invention comprises a startup circuit and a bias circuit being connected to each other between a power supply and the ground, the startup circuit operating at power-on and the bias circuit starting to pass current when the startup circuit operates, the startup circuit outputting a starting voltage at power-on according to a control voltage at a power supply level on one end of a capacitor having the other end connected to the power supply, the starting voltage serving as a trigger for starting passing current through the bias circuit, the bias circuit starting passing current while using the starting voltage from the startup circuit as a trigger, bringing the control voltage on the end of the capacitor to the ground level after passing the current, and outputting a bias voltage for interrupting the starting voltage.

A current source circuit of the present invention comprises a startup circuit and a bias circuit being connected to each other between a power supply and the ground, the startup circuit operating at power-on, the bias circuit starting to pass current when the startup circuit operates, the startup circuit comprising a first capacitor connected between the power supply and a control voltage node, a first NMOS transistor having a drain connected to the control voltage node, a source connected to the ground, and a gate connected to an isolating voltage node for outputting a bias voltage from the bias circuit, and a second NMOS transistor having a gate connected to the control voltage node and a drain-source path formed between the ground and a starting voltage node for outputting a trigger for starting passing current through the bias circuit, the bias circuit having a current mirror circuit formed therein, starting passing current of the current mirror circuit in response to a trigger from the startup circuit to the starting voltage node, and outputting the bias voltage to the isolating voltage node after passing the current through the current mirror circuit.

A current source circuit of the present invention comprises a startup circuit and a bias circuit being connected to each other between a power supply and the ground, the startup circuit operating at power-on, the bias circuit starting to pass current when the startup circuit operates, the startup circuit comprising a first PMOS transistor having a source connected to the power supply and having a gate and a drain connected to a shift voltage node, a second capacitor connected between the shift voltage node and the ground, a third capacitor having one end connected to the power supply, a fourth NMOS transistor having a drain connected to the other end of the third capacitor, a gate connected to the shift voltage node, and a source connected to a control voltage node, a fifth NMOS transistor having a drain connected to the control voltage node, a gate connected to an isolating voltage node for outputting a bias voltage from the bias circuit, and a source connected to the ground, and a sixth NMOS transistor having a drain connected to a starting voltage node, a gate connected to the control voltage node, and a source connected to the ground, the bias circuit having a current mirror circuit formed therein, starting passing current of the current mirror circuit in response to a trigger from the startup circuit to the starting voltage node, and outputting the bias voltage to the isolating voltage node after passing the current through the current mirror circuit.

A current source circuit of the present invention comprises a startup circuit and a bias circuit being connected to each other between a power supply and the ground, the startup circuit operating at power-on, the bias circuit starting to pass current when the startup circuit operates, the startup circuit comprising a second PMOS transistor having a source connected to the power supply, a gate connected to an isolating voltage node from the bias circuit, and a drain connected to a shift voltage node, a fourth capacitor connected between the shift voltage node and the ground, a third PMOS transistor having a source connected to the power supply and a gate connected to a control voltage node, a fourth PMOS transistor having a source connected to the power supply, a gate connected to the drain of the third PMOS transistor, and a drain connected to the gate of the third PMOS transistor, an eighth NMOS transistor having a drain connected to the gate of the fourth PMOS transistor, a gate connected to the shift voltage node, and a source connected to the ground, a fifth PMOS transistor having a source connected to the control voltage node, a gate connected to the shift voltage node, and a drain connected to the ground, and a sixth PMOS transistor having a source connected to the power supply, a gate connected to the control voltage node, and a drain connected to the starting voltage node, the bias circuit having a current mirror circuit formed therein, starting passing current of the current mirror circuit in response to a trigger from the startup circuit to the starting voltage node, and outputting a bias voltage to the isolating voltage node after passing the current through the current mirror circuit.

As described above, after the start of the bias circuit, the startup circuit is isolated from the bias circuit according to the bias voltage generated on the isolating voltage node from the bias circuit to the startup circuit, and steady current consumption can be prevented in the startup circuit.

Therefore, it is possible to eliminate unnecessary power consumption after the start of the bias circuit, thereby further reducing the power consumption of the overall circuit.

DESCRIPTION OF THE EMBODIMENT

A current source circuit showing embodiments of the present invention will be specifically discussed below with reference to the accompanying drawings.

Embodiment 1

A current source circuit will be discussed below according to Embodiment 1 of the present invention.

Figure 1:
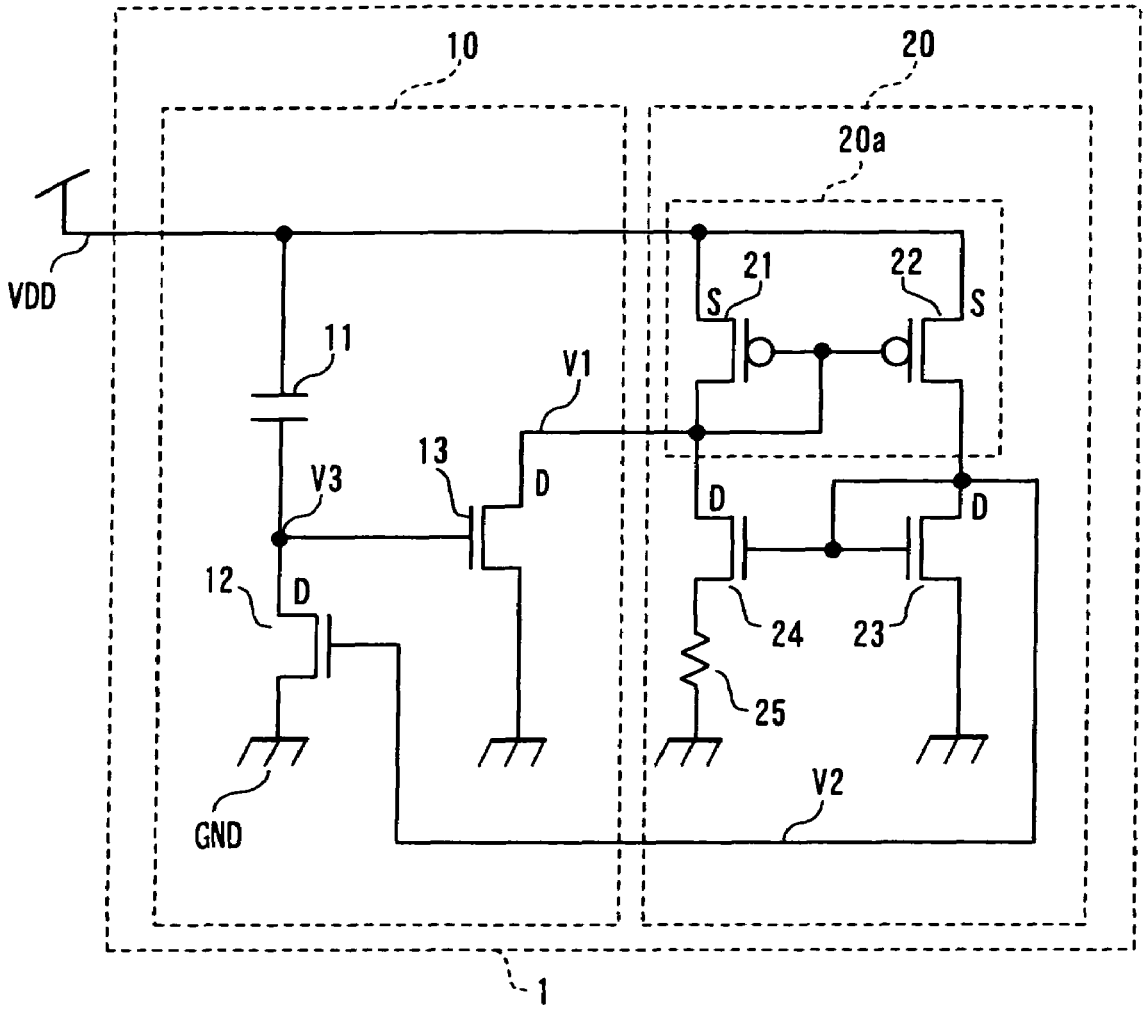
FIG. 1 is a circuit diagram showing the configuration of a current source circuit according to Embodiment 1 of the present invention.

FIG. 1 is a circuit diagram showing the configuration of the current source circuit according to Embodiment 1. In FIG. 1, in the basic configuration of the current source circuit 1 of the present embodiment, a startup circuit 10 and a bias circuit 20 are connected to each other. The startup circuit 10 operates between a power supply VDD and ground GND when the power supply VDD is turned on, and the bias circuit 20 starts to pass current when the startup circuit 10 operates.

The startup circuit 10 is comprised of a capacitor 11 connected between the power supply VDD and a control voltage node V3, an NMOS transistor 12 having a drain connected to the control voltage node V3, a source connected to the ground GND, and a gate connected to an isolating voltage node V2 from the bias circuit 20, and an NMOS transistor 13 having a gate connected to the control voltage node V3, a source connected to the ground GND, and a drain connected to a starting voltage node V1 for outputting a trigger for starting passing current through the bias circuit 20.

The bias circuit 20 is identical in configuration to that of the conventional art, and thus the explanation thereof is omitted.

The following will discuss the operations of the current source circuit 1 configured thus.

First, when the power supply VDD is applied, the isolating voltage node V2 is at the voltage level of the ground GND and the NMOS transistor 12 is nonconducting. Thus, the voltage across the capacitor 11 reaches the level of the power supply VDD, the NMOS transistor 13 is forced into conduction, and the voltage of the starting voltage node V1 is dropped.

When the voltage of the starting voltage node V1 is dropped thus, PMOS transistors 21 and 22 comprising a current mirror circuit 20*a* decrease in gate voltage and the bias circuit 20 starts to pass current through the transistors. When current starts passing through the current mirror circuit 20*a*, the current also passes through NMOS transistors 23 and 24 and a resistor 25 and bias current is generated on the isolating voltage node V2.

When the bias current having been generated on the isolating voltage node V2 is applied to the gate of the NMOS transistor 12, the NMOS transistor 12 is forced into conduction, electric charge accumulated in the capacitor 11 is discharged, and the voltage of the control voltage node V3 decreases and reaches the voltage level of the ground GND. When the voltage of the control voltage node V3 comes close to the voltage level of the ground GND, the NMOS transistor 13 is brought out of conduction and the startup circuit 10 is electrically isolated from the bias circuit 20.

As described above, according to Embodiment 1, the control voltage of the control voltage node V3 for controlling the conducting state of the NMOS transistor 13 is applied to the gate of the NMOS transistor 13 for generating the starting voltage of the starting voltage node V1 to the bias circuit 20 and the control voltage of the control voltage node V3. The control voltage is generated by a circuit in which the power supply VDD, the capacitor 11, the NMOS transistor 12, and the ground GND are connected in series. The series circuit is connected with the capacitor 11. Thus, even in the case where the NMOS transistor 12 is forced into conduction by applying the bias voltage to the isolating voltage node V2 from the bias circuit 20, steady current is not applied.

In other words, the startup circuit 10 is electrically isolated from the bias circuit 20 after the bias circuit 20 starts operating, and steady current consumption does not occur.

Embodiment 2

A current source circuit will be discussed below according to Embodiment 2 of the present invention.

Figure 2:
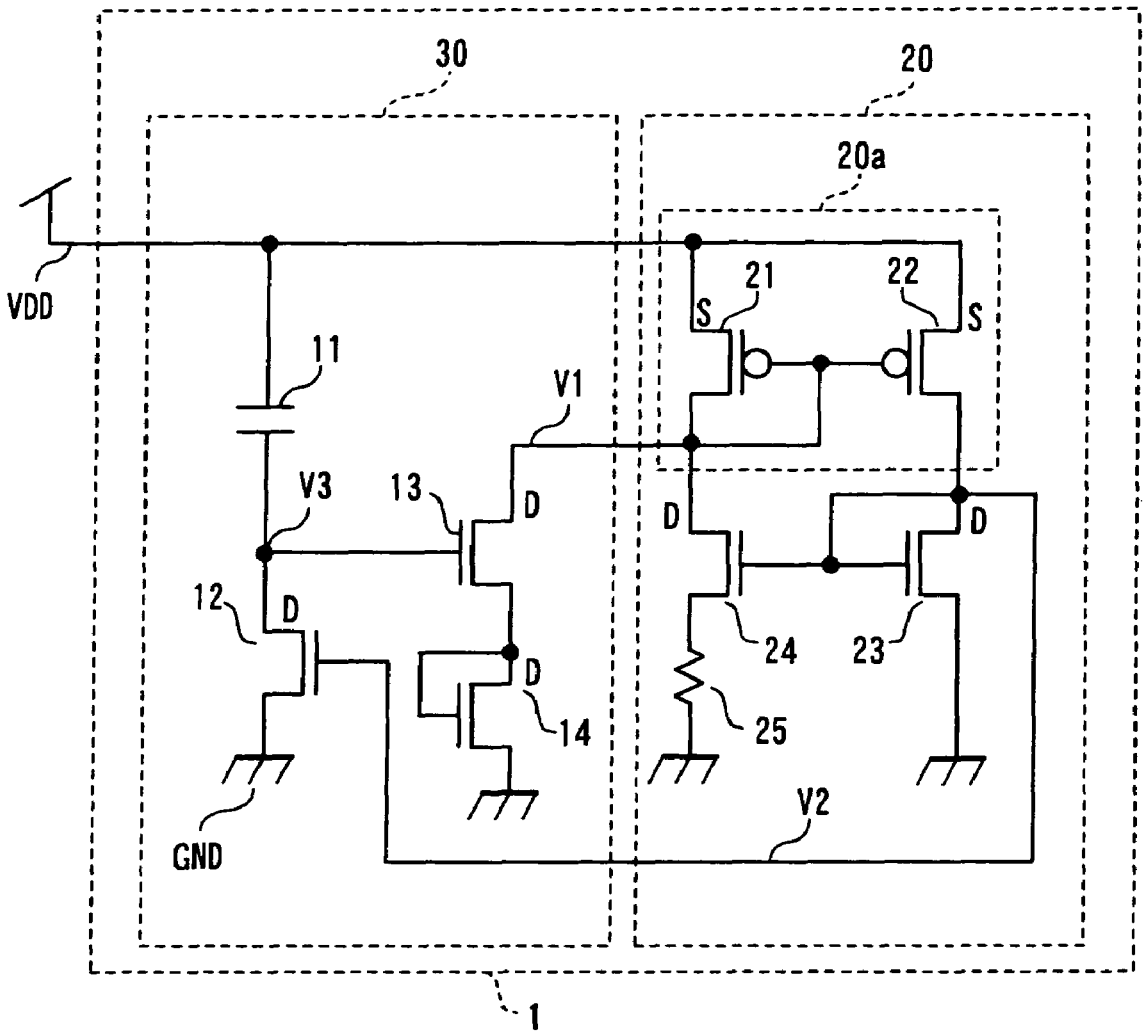
FIG. 2 is a circuit diagram showing the configuration of a current source circuit according to Embodiment 2 of the present invention.

FIG. 2 is a circuit diagram showing the configuration of the current source circuit according to Embodiment 2. In FIG. 2, in the basic configuration of the current source circuit 1 of Embodiment 2, a startup circuit 30 and a bias circuit 20 are connected to each other. The startup circuit 30 operates between a power supply VDD and ground GND when the power supply VDD is turned on, and the bias circuit 20 starts to pass current when the startup circuit 30 operates.

The startup circuit 30 is comprised of a capacitor 11 connected between the power supply VDD and a control voltage node V3, an NMOS transistor 12 having a drain connected to the control voltage node V3, a source connected to the ground GND, and a gate connected to an isolating voltage node V2 from the bias circuit 20, an NMOS transistor 13 having a gate connected to the control voltage node V3 and a drain connected to a starting voltage node V1 for outputting a trigger for starting passing current to the bias circuit 20, and an NMOS transistor 14 having a drain and a gate connected to the source of the NMOS transistor 13 and a source connected to the ground GND.

The bias circuit 20 is identical in configuration to that of the conventional art, and thus the explanation thereof is omitted. Further, the operations of the current source circuit 1 of Embodiment 2 configured thus are the same as Embodiment 1, and thus the explanation thereof is omitted.

As described above, the source voltage of the NMOS transistor 13 serves as the threshold voltage of the NMOS transistor 14 in a conducting state. As compared with Embodiment 1, a voltage difference between the gate and source of the NMOS transistor 13 decreases in Embodiment 2, thereby reducing the drain current of the NMOS transistor 13. That is, it is possible to reduce current consumption in the startup circuit 30 at power-on.

In Embodiment 2, the NMOS transistor 14 with a MOS diode structure is used to reduce current consumption at power-on. The same effect can be obtained by a PMOS transistor with a MOS diode structure having a source connected to the source of the NMOS transistor 13 and having a gate and a drain connected to the ground GND, a PN junction diode having a cathode connected to the source of the NMOS transistor 13 and an anode connected to the ground GND, and a resistor between the source of the NMOS transistor 13 and the ground GND.

In Embodiment 2, the NMOS transistor 14 with a MOS diode structure is disposed between the NMOS transistor 13 and the ground GND. The same effect can be obtained by an NMOS transistor with a MOS diode structure having a drain and a gate connected to the gate and drain of a PMOS transistor 21 and a source connected to the drain of the NMOS transistor 13. The NMOS transistor may be disposed between the gate and drain of the PMOS transistor 21 and the drain of the NMOS transistor 13.

Embodiment 3

A current source circuit will be discussed below according to Embodiment 3 of the present invention.

Figure 3:
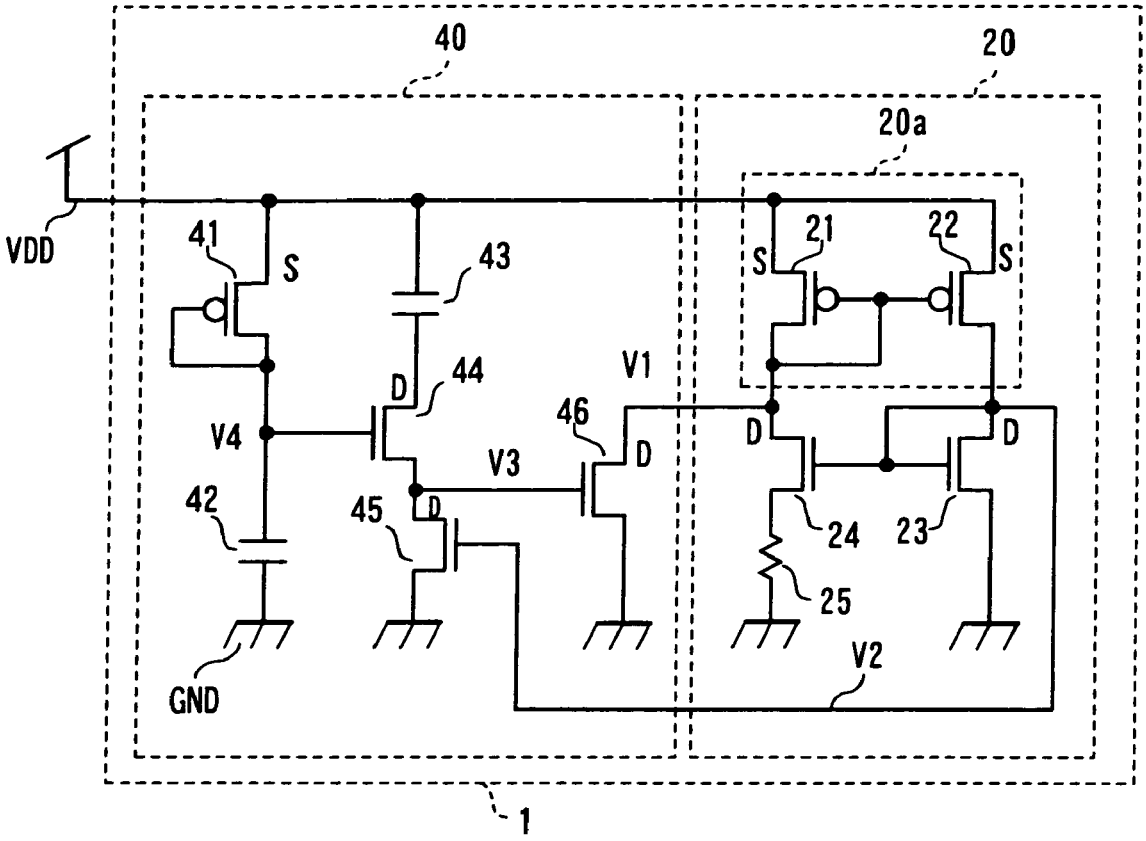
FIG. 3 is a circuit diagram showing the configuration of a current source circuit according to Embodiment 3 of the present invention.

FIG. 3 is a circuit diagram showing the configuration of the current source circuit according to Embodiment 3. In FIG. 3, in the basic configuration of the current source circuit 1 of Embodiment 3, a startup circuit 40 and a bias circuit 20 are connected to each other. The startup circuit 40 operates between a power supply VDD and ground GND when the power supply VDD is turned on, and the bias circuit 20 starts to pass current when the startup circuit 40 operates.

The startup circuit 40 is comprised of a PMOS transistor 41 having a source connected to the power supply VDD and having a gate and a drain connected to a shift voltage node V4, a capacitor 42 connected between the shift voltage node V4 and the ground GND, a capacitor 43 having one end connected to the power supply VDD, an NMOS transistor 44 having a drain connected to the other end of the capacitor 43, a gate connected to the shift voltage node V4, and a source connected to a control voltage node V3, an NMOS transistor 45 having a drain connected to the control voltage node V3, a gate connected to an isolating voltage node V2 from the bias circuit 20, and a source connected to the ground GND, and an NMOS transistor 46 having a drain connected to a starting voltage node V1, a gate connected to the control voltage node V3, and a source connected to the ground GND.

The bias circuit 20 is identical in configuration to that of the conventional art, and thus the explanation thereof is omitted.

The following will discuss the operations of the current source circuit 1 configured thus according to Embodiment 3.

First, immediately after the power supply VDD is applied, the voltage of the starting voltage node V1 is at the level of the power supply VDD, the voltage of the isolating voltage node V2 is at the level of the ground GND, and the NMOS transistors 45 and 46 are nonconducting. In the bias circuit 20, the PMOS transistors 21 and 22 and the NMOS transistors 23 and 24 are also nonconducting, and thus no current passes through the transistors.

Subsequently, current starts passing through the PMOS transistor 41 and electric charge is gradually accumulated in the capacitor 42, so that the voltage of the shift voltage node V4 increases. The NMOS transistor 44 is forced into conduction in response to the increase in the voltage of the shift voltage node V4. At this point, the voltage across the capacitor 43 is at the level of the power supply VDD. Thus, the voltage at the level of the power supply VDD is applied to the gate of the NMOS transistor 46 through the NMOS transistor 44 which is in a conducting state, and the NMOS transistor 46 is forced into conduction and reduces the voltage of the starting voltage node V1 to the ground level.

When the voltage of the starting voltage node V1 drops, the bias circuit 20 starts operating, current starts passing through the NMOS transistors 23 and 24 and the PMOS transistors 21 and 22 constituting a current mirror circuit 20*a*, and bias voltage is generated on the isolating voltage node V2. The NMOS transistor 45 is forced into conduction by generating the bias voltage, and electric charge accumulated in the capacitor 43 is discharged to the ground GND. At this point, the voltage of one end of the capacitor 43 drops and the control voltage of the control voltage node V3 also decreases. Thus, the NMOS transistor 46 decreases in gate voltage and is brought out of conduction, the startup circuit 40 is electrically isolated from the bias circuit 20, and the bias circuit 20 enters a stable operation state.

As described above, according to Embodiment 3, once the bias circuit 20 starts, the bias voltage on the isolating voltage node V2 is applied to the NMOS transistor 45. Even when the NMOS transistor 45 is forced into conduction, the PMOS transistor 41 and the capacitor 42 which generate the voltage of the shift voltage node V4 are connected in series, and thus steady current consumption does not occur in the series circuit. Further, the capacitor 43 and the NMOS transistors 44 and 45 which generate the voltage of the starting voltage node V1 are also connected in series, and thus steady current consumption does not occur in the series circuit. When the bias circuit 20 starts operating, the NMOS transistor 46 is brought out of conduction and thus no current is applied.

In other words, with this configuration, after the bias circuit 20 starts operating, the startup circuit 40 is isolated from the bias circuit 20 and steady current consumption can be prevented in the startup circuit 40.

In Embodiment 3, the PMOS transistor 41 with a MOS diode structure is used. The same effect can be obtained by an NMOS transistor having a MOS diode structure, a PN junction diode, and a resistor.

Embodiment 4

A current source circuit will be discussed below according to Embodiment 4 of the present invention.

Figure 4:
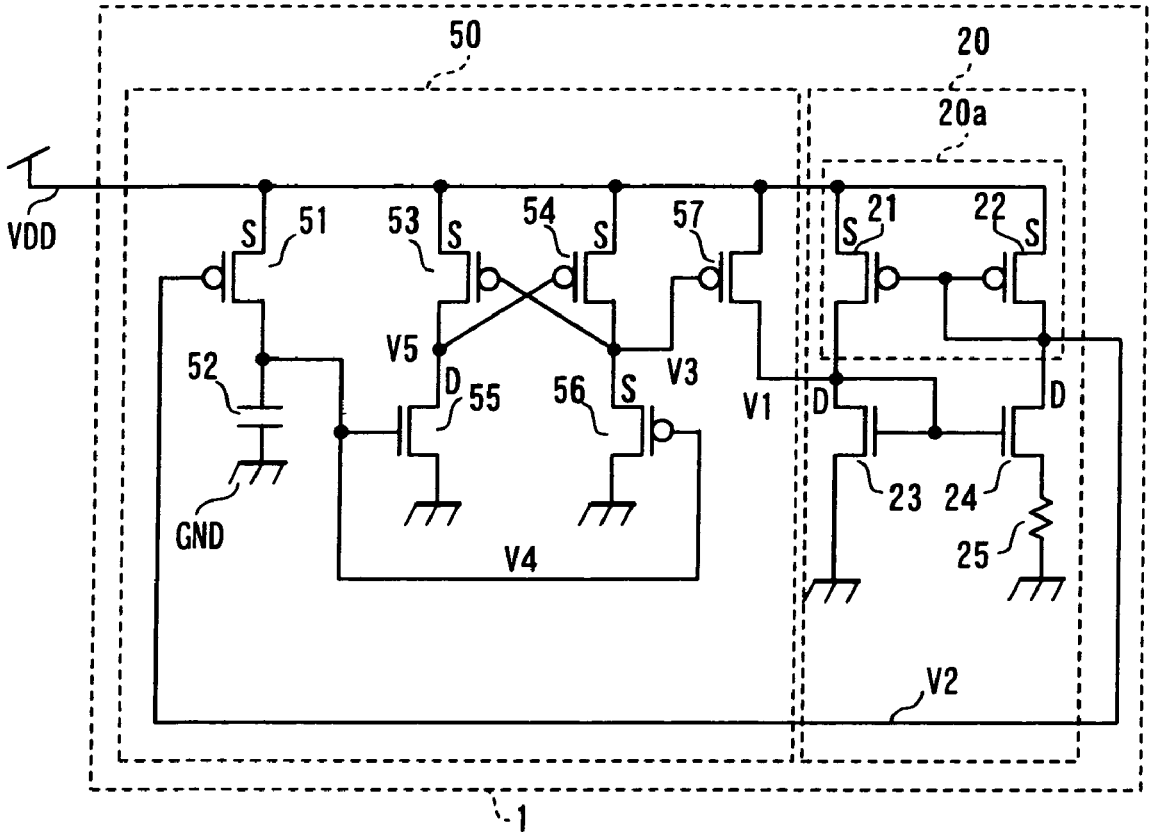
FIG. 4 is a circuit diagram showing the configuration of a current source circuit according to Embodiment 4 of the present invention.
Figure 5:
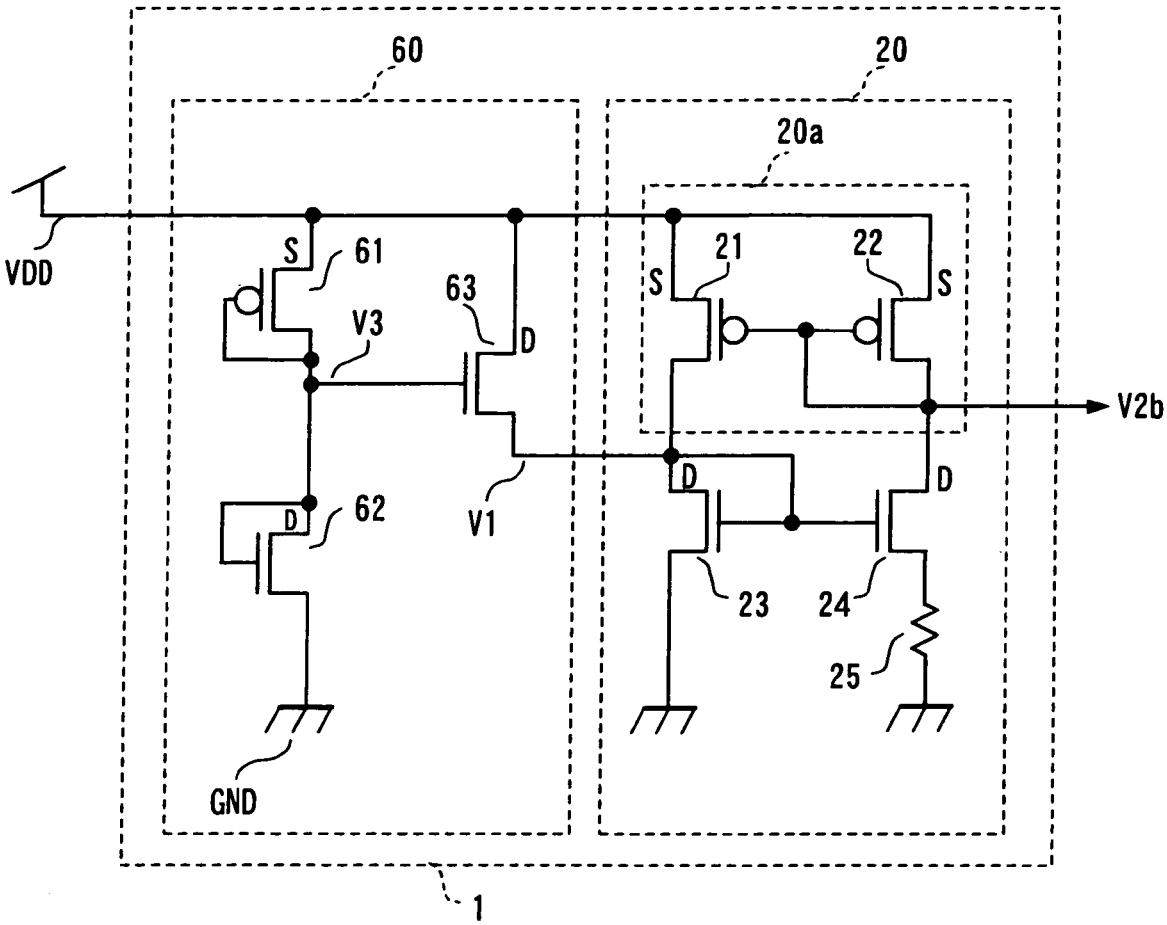
FIG. 5 PRIOR ART
FIG. 5 is a circuit diagram showing the configuration of a conventional current source circuit.

FIG. 4 is a circuit diagram showing the configuration of the current source circuit according to Embodiment 4. In FIG. 4, in the basic configuration of a current source circuit 1 of Embodiment 4, a startup circuit 50 and a bias circuit 20 are connected to each other. The startup circuit 50 operates between a power supply VDD and ground GND when the power supply VDD is turned on, and the bias circuit 20 starts to pass current when the startup circuit 50 operates.

The startup circuit 50 is comprised of a PMOS transistor 51 having a source connected to the power supply VDD, a gate connected to an isolating voltage node V2 from the bias circuit 20, and a drain connected to a shift voltage node V4, a capacitor 52 connected between the shift voltage node V4 and the ground GND, a PMOS transistor 53 having a source connected to the power supply VDD and a gate connected to a control voltage node V3, a PMOS transistor 54 having a source connected to the power supply VDD, a gate connected to the drain of the PMOS transistor 53, and a drain connected to the gate of the PMOS transistor 53, an NMOS transistor 55 having a drain connected to the gate of the PMOS transistor 54, a gate connected to the shift voltage node V4, and a source connected to the ground GND, a PMOS transistor 56 having a source connected to a control voltage node V3, a gate connected to the shift voltage node V4, and a drain connected to the ground GND, and a PMOS transistor 57 having a source connected to the power supply VDD, a gate connected to the control voltage node V3, and a drain connected to a starting voltage node V1.

The bias circuit 20 is identical in configuration to that of the conventional art, and thus the explanation thereof is omitted.

The following will discuss the operations of the current source circuit 1 configured thus according to Embodiment 4.

First, immediately after the power supply VDD is applied, the voltage of the starting voltage node V1 is at the level of the ground GND, the voltage of the isolating voltage node V2 is at the level of the power supply VDD, the PMOS transistors 21 and 22 and the NMOS transistors 23 and 24 are nonconducting in the bias circuit 20, and thus no current passes through the transistors. The PMOS transistor 51 is nonconducting and the voltage of the shift voltage node V4 is at the level of the ground GND. At this point, the NMOS transistor 55 and the PMOS transistor 54 are nonconducting and the PMOS transistors 53 and 56 are conducting. The voltage node V5 is at the level of the power supply VDD and the voltage of the control voltage node V3 is at the level of the ground GND.

The gate voltage of the PMOS transistor 57 reaches the level of the ground GND, and thus the PMOS transistor 57 is forced into conduction. The NMOS transistors 23 and 24 of the bias circuit 20 increase in gate voltage and start passing current. Thus, current starts passing through a current mirror circuit 20*a* and bias voltage is generated on the isolating voltage node V2.

When the bias voltage is generated on the isolating voltage node V2, the PMOS transistor 51 is forced into conduction, electric charge is accumulated in the capacitor 52, and the voltage of the shift voltage node V4 increases. The NMOS transistor 55 and the PMOS transistor 54 are forced into conduction in response to the increase in the voltage of the shift voltage node V4, the PMOS transistors 53 and 56 are brought out of conduction, the voltage of a voltage node V5 reaches the level of the ground GND, and the voltage of the control voltage node V3 reaches the level of the power supply VDD. Since the gate voltage of the PMOS transistor 57 reaches the level of the power supply VDD, the PMOS transistor 57 is brought out of conduction and electrically isolated from the bias circuit 20.

As described above, according to Embodiment 4, once the bias circuit 20 starts, the bias voltage on the isolating voltage node V2 is applied to the PMOS transistor 51. Even when the PMOS transistor 51 is forced into conduction, the PMOS transistor 51 and the capacitor 52 are connected in series, and thus steady current consumption does not occur in the series circuit. Further, in the series circuit of the PMOS transistor 53 and the NMOS transistor 55 and the series circuit of the PMOS transistors 54 and 56, when one of MOS transistors is conducting, the other MOS transistor is nonconducting. Thus, steady current consumption does not occur in the series circuits.

Further, the PMOS transistor 57 is brought out of conduction and passes no current when the bias circuit 20 starts operating. Therefore, with this configuration, after the bias circuit 20 starts operating, the startup circuit 50 is electrically isolated from the bias circuit 20 and steady current consumption can be prevented in the startup circuit 50.

What is claimed is:

1. A current source circuit, comprising a startup circuit and a bias circuit being connected to each other between a power supply and ground, the startup circuit operating at power-on, the bias circuit starting to pass current when the startup circuit operates, said startup circuit comprising:

a first PMOS transistor having a source connected to the power supply and having a gate and a drain connected to a shift voltage node;

a second capacitor connected between the shift voltage node and the ground;

a third capacitor having one end connected to the power supply;

a fourth NMOS transistor having a drain connected to the other end of the third capacitor, a gate connected to the shift voltage node, and a source connected to a control voltage node;

a fifth NMOS transistor having a drain connected to the control voltage node, a gate connected to an isolating voltage node for outputting a bias voltage from the bias circuit, and a source connected to the ground; and a sixth NMOS transistor having a drain connected to a starting voltage node, a gate connected to the control voltage node, and a source connected to the ground, said bias circuit having a current mirror circuit formed therein, starting passing current of the current mirror circuit in response to a trigger from the startup circuit to the starting voltage node, and outputting the bias voltage to the isolating voltage node after passing the current through the current mirror circuit.

2. A current source circuit, comprising a startup circuit and a bias circuit being connected to each other between a power supply and ground, the startup circuit operating at power-on, the bias circuit starting to pass current when the startup circuit operates, said startup circuit, comprising:

a seventh NMOS transistor having a drain and a gate connected to the power supply and having a source connected to a shift voltage node;

a second capacitor connected between the shift voltage node and the ground;

a third capacitor having one end connected to the power supply;

a fourth NMOS transistor having a drain connected to the other end of the third capacitor, a gate connected to the shift voltage node, and a source connected to a control voltage node;

a fifth NMOS transistor having a drain connected to the control voltage node, a gate connected to an isolating voltage node for outputting a bias voltage from the bias circuit, and a source connected to the ground; and a sixth NMOS transistor having a drain connected to a starting voltage node, a gate connected to the control voltage node, and a source connected to the ground, said bias circuit having a current mirror circuit formed therein, starting passing current of the current mirror circuit in response to a trigger from the startup circuit to the starting voltage node, and outputting the bias voltage to the isolating voltage node after passing the current through the current mirror circuit.

* * * * *